US009920625B2

(12) United States Patent
Rawlings et al.

(10) Patent No.: US 9,920,625 B2
(45) Date of Patent: Mar. 20, 2018

(54) TURBINE BLADE WITH LATERALLY BIASED AIRFOIL AND PLATFORM CENTERS OF MASS

(75) Inventors: Christopher Rawlings, Stuart, FL (US); Robert M. Dysert, Jupiter, FL (US); Billie E. Sealey, Jensen Beach, FL (US); Jose Paulino, Jupiter, FL (US); Anthony J. Malandra, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1589 days.

(21) Appl. No.: 13/005,733

(22) Filed: Jan. 13, 2011

(65) Prior Publication Data

US 2012/0183405 A1 Jul. 19, 2012

(51) Int. Cl.
*F01D 5/14* (2006.01)
*F01D 5/02* (2006.01)

(52) U.S. Cl.
CPC ..... *F01D 5/027* (2013.01); *F01D 5/147* (2013.01); *F05D 2260/15* (2013.01); *F05D 2260/961* (2013.01)

(58) Field of Classification Search
CPC . F01D 5/027; F01D 5/147; F01D 5/14; F05D 2260/961; F05D 2260/15
USPC .... 416/193 A, 228, 229 A, 234, 238, 241 R, 416/243, 223 A, 202
See application file for complete search history.

(56) References Cited

U.S. PATENT DOCUMENTS

| | | | | |
|---|---|---|---|---|
| 4,585,395 | A * | 4/1986 | Nourse et al. | 416/223 A |
| 4,682,935 | A * | 7/1987 | Martin | 416/223 A |
| 5,044,885 | A | 9/1991 | Odoul et al. | |
| 5,725,354 | A | 3/1998 | Wadia et al. | |
| 5,785,499 | A | 7/1998 | Houston et al. | |
| 6,042,336 | A | 3/2000 | Bulgrin et al. | |
| 6,273,683 | B1 | 8/2001 | Zagar et al. | |
| 6,299,412 | B1 | 10/2001 | Wood et al. | |
| 6,338,611 | B1 | 1/2002 | Anderson et al. | |
| 6,786,696 | B2 * | 9/2004 | Herman et al. | 416/96 R |
| 2007/0258817 | A1 | 11/2007 | Allen-Bradley et al. | |
| 2008/0101959 | A1 * | 5/2008 | McRae et al. | 416/223 R |
| 2008/0273984 | A1 * | 11/2008 | Liang et al. | 416/223 R |
| 2009/0208339 | A1 | 8/2009 | Cherolis et al. | |
| 2010/0158696 | A1 * | 6/2010 | Pandey et al. | 416/243 |

* cited by examiner

*Primary Examiner* — Woody Lee, Jr.
*Assistant Examiner* — Maxime Adjagbe

(57) ABSTRACT

A turbine blade airfoil (32) with a center of mass (ACM) that is laterally offset from the center of mass (PCM) of a platform (42) to which the airfoil is attached. Respective offsets ($d_a$, $d_p$) balance these centers of mass (ACM, PCM) about an attachment plane (64) of the blade root (30), providing balanced centrifugal loading on opposite lobes (51, 52) or other attachment surfaces of the root. The attachment plane (64) may be a plane of bilateral symmetry of the root, and/or it may include an attachment axis (65) that passes through the root center of mass (RCM) along a radius of rotation of the airfoil. The airfoil and platform centers of mass (ACM, PCM) may be dynamically balanced about the attachment axis (65) and/or the attachment plane (64).

20 Claims, 5 Drawing Sheets

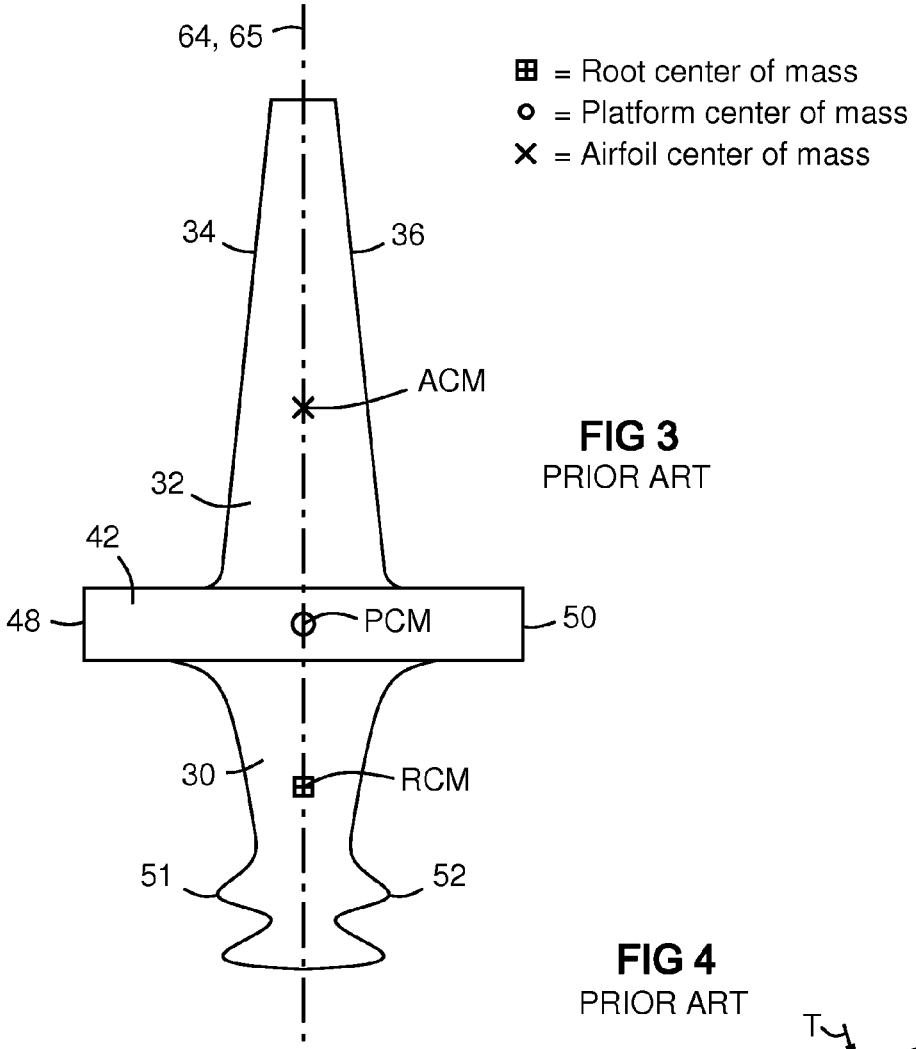
FIG 3
PRIOR ART
FIG 4
PRIOR ART
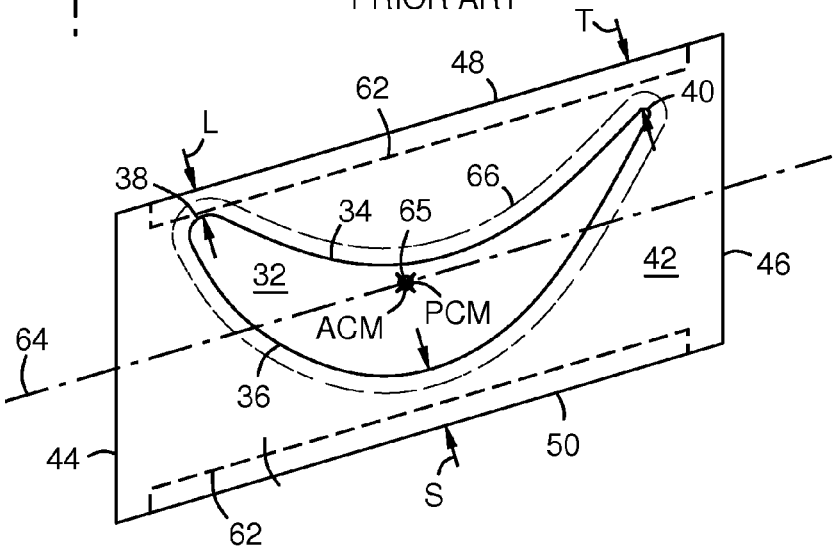

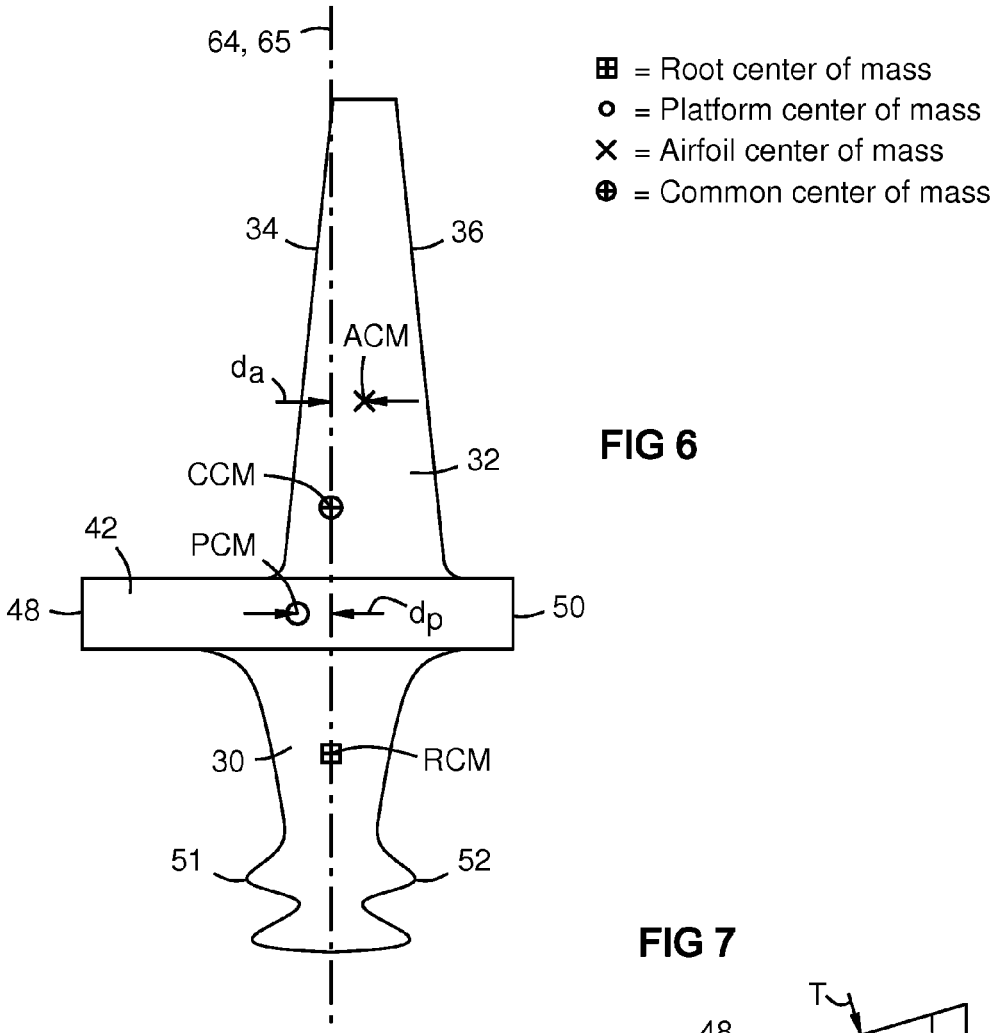
FIG 6
FIG 7
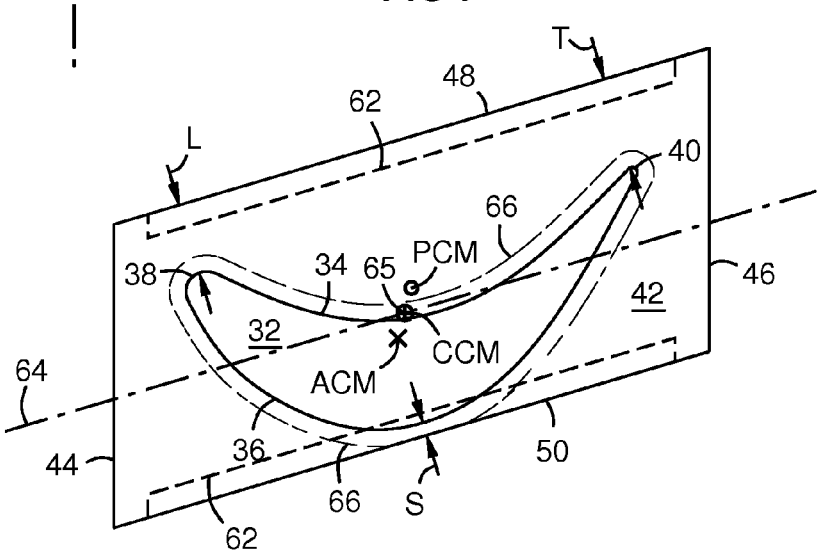

TURBINE BLADE WITH LATERALLY BIASED AIRFOIL AND PLATFORM CENTERS OF MASS

FIELD OF THE INVENTION

The invention relates to rotating turbine blade/disc assemblies in gas turbines, and particularly to balancing or stacking the mass of a blade airfoil and platform over an attachment axis or plane of symmetry of the blade root.

BACKGROUND OF THE INVENTION

Gas turbine blades are mounted on the circumference of a rotating disc in a circular array as shown in FIG. 1. They are often attached removably to the disc so they can be individually tested, serviced, and replaced. The rotation rate of industrial gas turbines may be 3600 rpm for 60 Hz power generation, and much higher for aero engines. There is aerodynamic stress on turbine blades, but the greatest mechanical stress is the centrifugal force on the blade attachments, which can be 70,000 lbs or more per blade. Herein "centrifugal force" or "reactive centrifugal force" is the force exerted radially outwardly by a body on a structure that retains the body in circular motion.

Each blade includes an airfoil section and a platform that forms an inner shroud ring with adjacent platforms. The inner shroud ring separates the combustion working gas from cooling air supplied to channels in the blade via channels in the disc. Each blade is connected to the disc by an attachment device called a root. In order to distribute the centrifugal loads evenly on opposed surfaces of the root, it is common to align the centers of mass of the airfoil, platform, and root along a rotation radius called an attachment or stacking axis. The goal is actually to have the sum of moments about an attachment plane of the blade to be approximately zero during operation of the blade to balance forces on the blade root lobes. The predominant operating load is the centrifugal load, although the airfoil lift load also contributes to the operating loads to a much lesser degree, so the center of mass of the airfoil and/or platform may be offset by a small dimension from the attachment plane in order to offset the airfoil lift moment.

BRIEF DESCRIPTION OF THE DRAWINGS

The invention is explained in the following description in view of the drawings that show:

FIG. 3 is a schematic front view of a prior turbine blade, platform, and root.

FIG. 4 is a top view or radially outer view of a prior turbine blade and platform.

FIG. 6 is a schematic front view of a turbine blade, platform, and root per aspects of the invention.

FIG. 7 is a top view of a turbine blade and platform per aspects of the invention.

DETAILED DESCRIPTION OF THE INVENTION

The present inventors have now recognized that the prior art approach of aligning the centers of mass of the airfoil, platform, and root along a stacking axis constrains the position of the airfoil on the platform, and it generally places the leading and trailing edges of the airfoil close to the pressure side edge of the platform. This locates the mechanical stress rise associated with the platform-to-airfoil filet weld to be near respective corners of the platform. It also locates the relatively higher pressure airfoil bow-wave over the leading edge of the platform, thereby increasing the possibility of leakage of combustion gas between platforms. The inventors have developed a turbine blade which overcomes these disadvantages.

Figure 1:
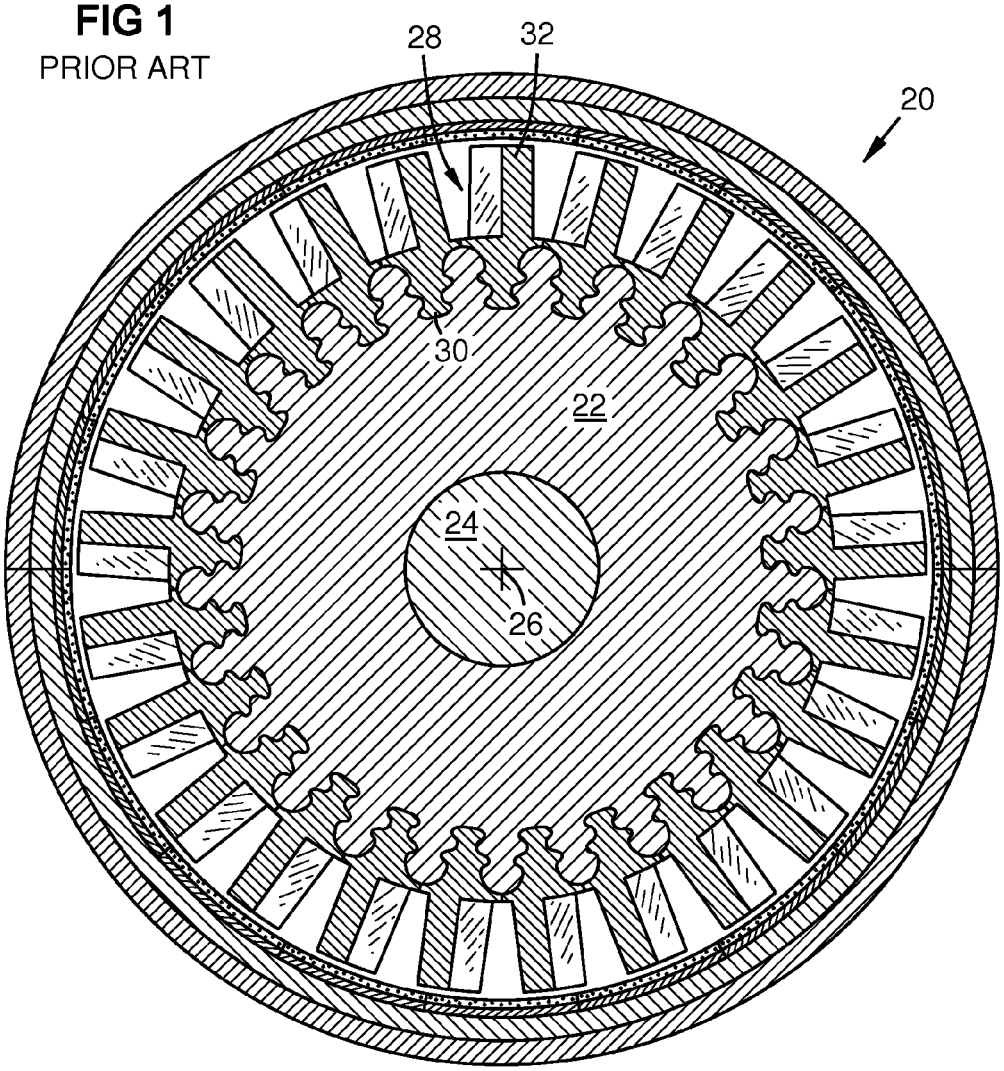
FIG 1 PRIOR ART
FIG. 1 is a schematic sectional view of a prior turbine disc with blades.

FIG. 1 schematically illustrates a prior art rotor assembly 20 of a gas turbine, including a disc 22 on a shaft 24 with an axis 26. A plurality of blades 28 are attached to the disc by roots 30, forming a circular array of airfoils 32 around the circumference of the disc.

Figure 2:
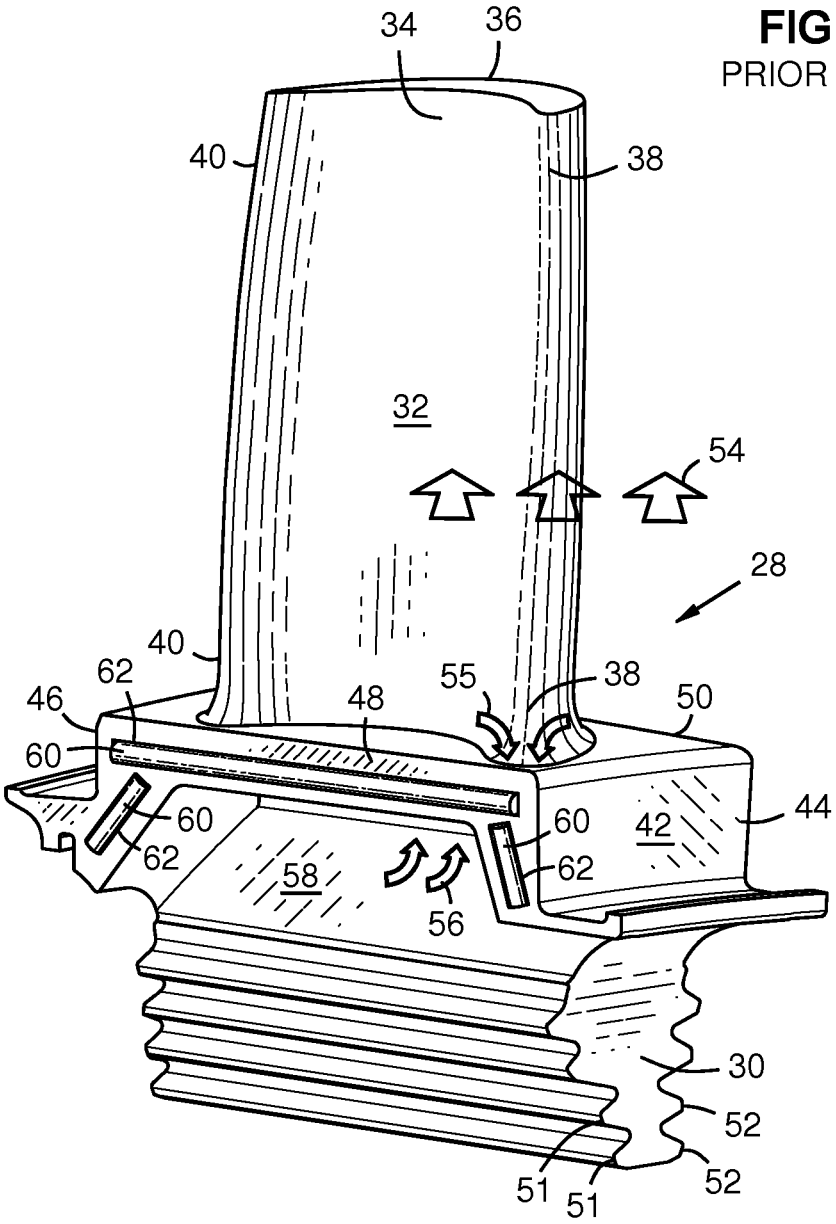
FIG 2 PRIOR ART
FIG. 2 is a perspective view of a prior turbine blade, platform, and root.

FIG. 2 illustrates a prior turbine blade 28, including an airfoil 32 with a pressure side 34, a suction side 36, a leading edge 38, and a trailing edge 40. The airfoil is attached to a platform 42 having front and back ends 44, 46 and pressure and suction side mate-faces 48, 50. Each mate-face contacts an adjacent platform in the circular array of blades shown in FIG. 1. The blade has a root 30 that attaches to the disc. The illustrated form of root is called a fir-tree root, with opposed lobes 51, 52 that slide into mating grooves in the disc. Other forms of root attachment may be used.

A combustion gas flow 54 from the turbine combustor aerodynamically drives the airfoils to rotate the disc and shaft. Cooling air 56 is provided to channels or chambers 58 in the platform from the turbine compressor via channels (not shown) in the turbine shaft and disc as known in the art. The cooling air may flow through channels in the blade, and may have a higher pressure than the combustion gas flow 54, which prevents leakage of the combustion gas into the cooling chamber 58. Seals 60 may be provided in grooves 62 in one or both mate-faces 48, 50 to minimize leakage of the coolant air 56 and the combustion gas 54 between the mate-faces of adjacent platforms. These seals 60 commonly take the form of cylinders and/or blades, but may take other forms.

A bow wave 55 forms in the combustion gas flow 54 meeting the leading edge 38. This creates a localized high pressure zone at the intersection of the leading edge and the platform 42 that may be locally higher than a pressure in the cooling chamber 58, thereby potentially causing leakage of the combustion gas between adjacent platforms into the cooling chamber 58. This can contaminate the coolant air, burn the seals, and locally overheat the platform at the high-stress fillet area near the leading edge 38.

FIG. 3 is a schematic front view of a prior turbine blade. The centers of mass of the airfoil ACM and the platform PCM are stacked along an attachment axis 65 that may coincide with a radius of rotation passing through the center of mass RCM of the root. This attachment axis 65 lies in an attachment plane 64 that may be a plane of bilateral symmetry of the root 30. Stacking the centers of mass in this way provides a uniform distribution of centrifugal force on opposed lobes 51, 52 or other surfaces of the root.

FIG. 4 shows a top view of an airfoil and platform with stacked centers of mass ACM, PCM in the attachment plane 64. To achieve such stacking, the leading 38 and trailing 40 edges of the airfoil are typically close to the pressure side mate-face 48. Dimension L is the distance from the leading edge 38 to the pressure side mate-face. T is the distance from the trailing edge 40 to the pressure side mate-face. S is the shortest distance from the suction side of the airfoil to the suction side mate-face. Blade-to-platform fillets 66 are indicated by broken lines. It is common for L to be less than or equal to S, and for the average of L and T to be less than or equal to S per the equation $(L+T)/2 \leq S$. Stress concentrations occur where the leading and trailing edges 38, 40 connect to the platform 42. Such stress concentrations close to an edge of the platform may reduce the design life of the blade, especially if seal slots 62 are located there.

Figure 5:
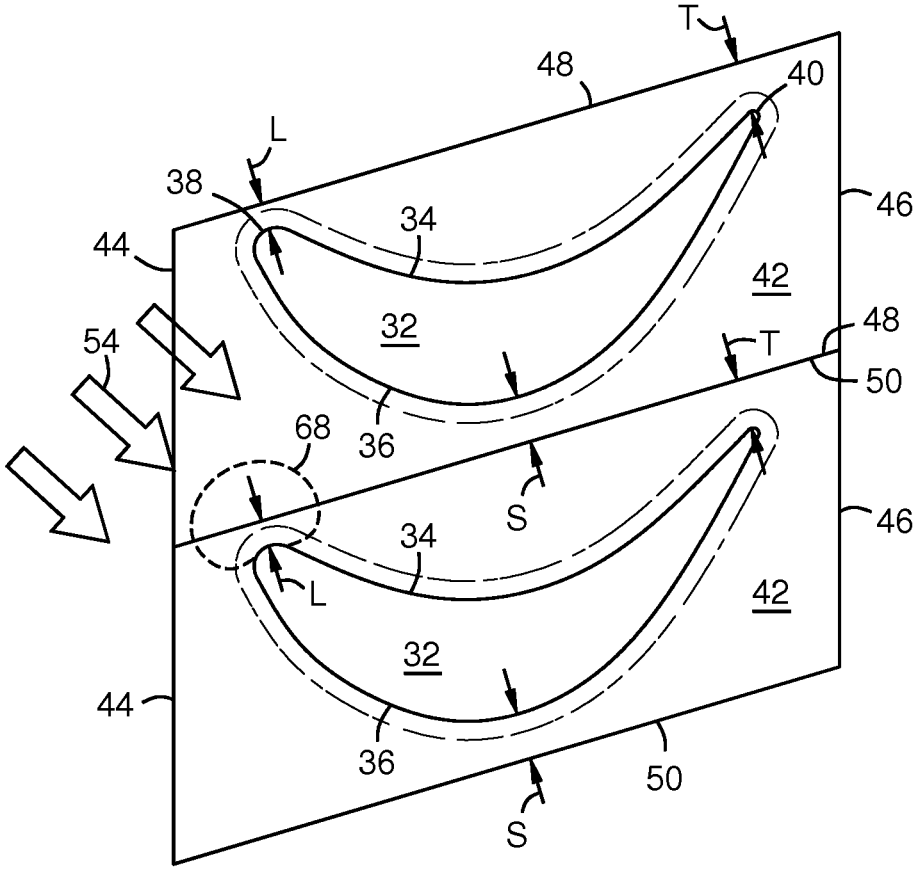
FIG 5 PRIOR ART
FIG. 5 is a top view of prior turbine blades and platforms with combustion flow.

FIG. 5 is a top view of two adjacent prior turbine blade airfoils 32 and platforms 42, showing a combustion gas flow 54 creating a high-pressure stagnation zone 68 across the adjacent mate-faces 48, 50 due to the bow wave.

FIG. 6 is a schematic front view of a turbine blade according to aspects of the invention, in which the airfoil 32 and platform 42 are laterally offset to opposite sides of the attachment plane 64 so that their operationally generated centrifugal forces essentially balance about the attachment plane after accounting for the airfoil imposed loads. One way to achieve balance is to locate the common center of mass CCM of the airfoil and platform on the attachment axis 65, or at least on the attachment plane 64, using a two-body center of mass calculation. Another method is to treat the problem like balancing a lever, using the equation $m_a*d_a=m_p*d_p$, (equation 1), where $m_a$ is the airfoil mass, $d_a$ is the distance of the airfoil center of mass ACM from the attachment plane 64, $m_p$ is the platform mass, and $d_p$ is the distance of the platform center of mass PCM from the attachment plane 64.

For convenience, the distances $d_a$ and $d_p$ are defined herein as the normal distance from each respective center of mass ACM, PCM to the attachment plane 64. Alternate definitions for $d_a$ and $d_p$ may be used that also produce balance across the attachment plane 64, including: 1) The distance between each respective center of mass ACM, PCM, and a common center of mass CCM that is either on the attachment axis 65 or at least in the attachment plane 64; and 2) The perpendicular distance from each respective center of mass ACM, PCM to the attachment axis 65.

Equation 2 below solves for the platform offset $d_p$ when the other values are known. A sample substitution of values into equation 2 is shown in equation 3. Thus, an airfoil of 2.00 kg mass ($m_a$) that is offset 1.00 cm ($d_a$) from the attachment plane 64, will balance with a platform of 1.00 kg mass ($m_p$) that is offset 2.00 cm ($d_p$) from the attachment plane 64.

$$m_a*d_a=m_p*d_p \quad 1)$$

$$d_p=(m_a*d_a)/m_p \quad 2)$$

$$d_p=(2.00\text{ kg}*1.00\text{ cm})/1.00\text{ kg}=2.00\text{ cm} \quad 3)$$

Formulas for the center-of-mass and the above formulas provide static balance. Dynamic balance can be achieved by taking into account the uneven radial distribution of the masses ACM, PCM. The reactive centrifugal force CF exerted by a mass m is $CF=mr\omega^2$ (where ω is angular velocity). The centrifugal forces of the airfoil and platform can be balanced about the attachment plane 64 using equation 5, which treats this problem like balancing a lever. Since ω is the same for both masses, equation 5 simplifies to equation 6, which can be arranged to solve for any single variable in terms of the others. Equation 7 solves for the platform offset $d_p$ when the other values are known. A sample substitution of values into equation 7 is shown in equation 8. Thus, an airfoil of 2.00 kg mass ($m_a$) centered at a radius of 50.00 CM ($r_a$), and offset 1.00 cm ($d_a$) from the attachment plane 64, will balance with a platform of 1.00 kg mass ($m_p$) centered at a radius of 45.00 cm ($r_p$), and offset 2.22 cm ($d_r$) from the attachment plane 64.

$$CF=mr\omega^2 \text{ (}r\text{=radius, }m\text{=mass, }\omega\text{=angular velocity).} \quad 4)$$

$$m_a r\omega^2 d_a=m_p r\omega^2 d_p \text{ (CFs of airfoil and platform are balanced)} \quad 5)$$

$$m_a r_a d_a=m_p r_p d_p \text{ (}\omega^2\text{ cancels, since it is equal on both sides)} \quad 6)$$

$$d_p=m_a r_a d_a/m_p r_p \quad 7)$$

$$d_r=(2.00\text{ kg}*50.00\text{ cm}*1.00\text{ cm})/(1.00\text{ kg}*45.00\text{ cm})=2.22\text{ cm} \quad 8)$$

One skilled in the art will appreciate that the immediately preceding exemplary discussion ignores the moment contribution of the airfoil loads for simplification purposes, but that such loads can be routinely accounted for using known techniques for the various embodiments of the invention. Further, using the static balance technique (locating the two-body center of mass in the attachment plane 64 or on the attachment axis 65), the centrifugal forces will be unbalanced in the correct direction to compensate for such aero forces, i.e. they will be unbalanced toward the suction side of the root. However, it is within the ability of one skilled in the art to calculate the aero torque on the root and to compensate accordingly using the dynamic formula.

FIG. 7 illustrates advantages of offsetting the airfoil 32 and platform 42. It can be seen that the platform center of mass (PCM) is located on the pressure side of the attachment plane 64 and the airfoil center of mass (ACM) is located on the suction side of the attachment plane 64. The leading and trailing edges 38, 40 of the airfoil are now farther from the pressure side mate-face 48 of the platform than in FIG. 4. It is acceptable for the suction side distance S to be short, since the suction side of the airfoil does not create a bow wave and does not create as high a stress concentration as the leading and trailing edges of the airfoil. For this reason, the fillet 66 on the suction side may meet the suction side mate-face 50, or the fillet may be cut-off by the suction side-mate face, even to an extent that the suction side 36 of the airfoil meets the suction-side mate face. Distance L may be at least twice or at least three times distance S in some embodiments. In one embodiment, the average of L and T may be at least four times distance S per the equation $(L+T)/2 \geq 4*S$.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine blade comprising:

a platform having a platform center of mass;

a root attached to a first side of the platform and having a root center of mass;

an airfoil attached to a second side of the platform and having an airfoil center of mass;

wherein the airfoil center of mass and the platform center of mass are offset to opposite sides of an attachment plane of the turbine blade.

2. The turbine blade of claim 1, wherein the root is attached to a turbine disc, a radius of rotation passes through the root center of mass in the attachment plane, and the airfoil and the platform have a combined center of mass disposed in the attachment plane.

3. The turbine blade of claim 2, wherein the combined center of mass is a point in said radius of rotation.

4. The turbine blade of claim 1, wherein the airfoil and platform centers of mass are offset from the attachment plane according to the formula $m_a * d_a = m_p * d_p$, where $m_a$ is the airfoil mass, $d_a$ is the distance of the airfoil center of mass from the attachment plane, $m_p$ is the platform mass, and $d_p$ is the distance of the platform center of mass from the attachment plane.

5. The turbine blade of claim 1, wherein the root is mounted on a turbine disc having a rotation axis, and the airfoil and platform are dynamically balanced about the attachment plane according to the formula $m_a r_a d_a = m_p r_p d_p$ where $m_a$ is the airfoil mass, $r_a$ is the radial distance of the airfoil center of mass from the rotation axis, $d_a$ is the distance of the airfoil center of mass from the attachment plane, $m_p$ is the platform mass, $r_p$ is the radial distance of the platform center of mass from the rotation axis, and $d_p$ is the distance of the platform center of mass from the attachment plane.

6. The turbine blade of claim 5, wherein the attachment plane includes a radius of rotation of the turbine disc that passes through the root center of mass.

7. The turbine blade of claim 6, wherein the airfoil and platform are dynamically balanced about the radius of rotation that passes through the root center of mass.

8. The turbine blade of claim 1, wherein the airfoil is attached to the platform with a fillet, and the fillet on a suction side of the airfoil meets a suction side mate-face of the platform.

9. The turbine blade of claim 1, wherein the airfoil comprises a leading edge with a closest distance L from a pressure side mate-face of the platform, and a suction side with a closest distance S from a suction side mate-face of the platform, and $L \geq 3 * S$.

10. The turbine blade of claim 9, wherein the airfoil further comprises a trailing edge with a closest distance T from the pressure side mate-face of the platform, wherein $(L+T)/2 \geq 4 * S$.

11. The turbine blade of claim 10, wherein the airfoil comprises a suction side fillet that meets the suction side mate-face of the platform.

12. A turbine blade comprising:

a platform having a platform center of mass;

a root attached to a first side of the platform, wherein the root has a plane of bilateral symmetry;

an airfoil attached to a second side of the platform, wherein the airfoil has an airfoil center of mass;

wherein the airfoil and the platform centers of mass are offset to opposite sides of the plane of bilateral symmetry by respective distances that balance operating forces on the blade root.

13. The turbine blade of claim 12, wherein the root is mounted on a turbine disc with a rotation axis, and the airfoil and platform are balanced about the plane of bilateral symmetry according to the formula $m_a r_a d_a = m_p r_p d_p$ where $m_a$ is the airfoil mass, $r_a$ is the radial distance of the airfoil center of mass from the rotation axis, $d_a$ is the distance of the airfoil center of mass from the plane of bilateral symmetry, $m_p$ is the platform mass, $r_p$ is the radial distance of the platform center of mass from the rotation axis, and $d_p$ is the distance of the platform center of mass from the plane of bilateral symmetry.

14. The turbine blade of claim 13, wherein the airfoil and platform are dynamically balanced about a radius of rotation of the disc that passes through a center of mass of the root in the plane of bilateral symmetry.

15. The turbine blade of claim 13, wherein the airfoil is attached to the platform along a fillet, and the fillet on a suction side of the airfoil meets a suction side mate-face of the platform.

16. The turbine blade of claim 12, wherein the airfoil comprises a leading edge at a closest distance L from a pressure side mate-face of the platform, and comprises a suction side at a distance S from a suction side mate-face of the platform, and $L \geq 2 * S$.

17. The turbine blade of claim 16, wherein the airfoil further comprises a trailing edge at a closest distance T from the pressure side mate-face of the platform, wherein $(L+T)/2 \geq 4 * S$.

18. A turbine blade having an attachment plane, an airfoil, and a platform with a pressure side mate face and a suction side mate face, wherein the improvement comprises:

a center of mass of the platform being disposed on a pressure side of the attachment plane; and a center of mass of the airfoil being disposed on a suction side of the attachment plane.

19. The turbine blade of claim 18, further comprising a fillet between the airfoil and the platform, wherein the fillet meets the suction side mate face of the platform.

20. The turbine blade of claim 18, wherein the airfoil comprises a leading edge with a closest distance L from the pressure side mate-face of the platform of the blade, and a suction side with a closest distance S from the suction side mate-face of the platform, and the distance L being at least twice the distance S.

* * * * *